United States Patent [19]

Mancini

[11] 3,994,440

[45] Nov. 30, 1976

[54] DOOR ATTACHED SPRAY DISPENSER

[75] Inventor: Anthony Mancini, Yonkers, N.Y.

[73] Assignee: The Raymond Lee Organization, Inc., New York, N.Y. ; a part interest

[22] Filed: July 28, 1975

[21] Appl. No.: 599,701

[52] U.S. Cl. ..... 239/274

[51] Int. Cl.[2] ..... B05B 15/00; A61M 9/00

[58] Field of Search ..... 239/274, 282, 283; 222/160, 162, 180; 109/29

[56] References Cited

UNITED STATES PATENTS

| | | | |
|---|---|---|---|
| 2,534,465 | 12/1950 | Marini | 239/274 |
| 3,344,959 | 10/1967 | Faso | 222/162 X |
| 3,662,958 | 5/1972 | German | 239/274 |

FOREIGN PATENTS OR APPLICATIONS

| | | | |
|---|---|---|---|
| 1,151,924 | 2/1958 | France | 239/274 |

*Primary Examiner*—Evon C. Blunk
*Assistant Examiner*—Andres Kashnikow
*Attorney, Agent, or Firm*—Howard I. Podell

[57] ABSTRACT

A spray unit attachable to a door which ejects a spray into a room when the attached door is in the open position. The device is in the form of a bracket which holds an aerosol spray can in the erect position. A spring-biased knob that may be pushed downwards is pivotably mounted in the bracket directly over the center push button of the attached aerosol can. A wire rod which passes through the bracket is pivotably mounted to the door jamb near, not on, the hinge line of the door, with a bent section of the rod located to press upon the knob and cause the aerosol can to spray when the bent section slides over the knob when the door is opened.

2 Claims, 3 Drawing Figures

DOOR ATTACHED SPRAY DISPENSER

SUMMARY OF THE INVENTION

My invention is a spray unit attachable to a door which ejects a spray into a room when the attached door is in the open position. The device is in the form of a bracket which holds an aerosol spray can in the erect position. A spring-biased knob that may be pushed downwards is pivotably mounted in the bracket directly over the center push button of the attached aerosol can. A wire rod which passes through the bracket is pivotably mounted to the door jamb near, not on, the hinge line of the door, with a bent section of the rod located to press upon the knob and cause the aerosol can to spray when the bent section slides over the knob when the door is opened.

The invention is readily attachable to any door which is normally retained in the closed position and the aerosol container is readily removed and replaced.

By means of my invention, a spray of deodorant, insectide or antiseptic matter may be ejected into a room every time the doorway is entered.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
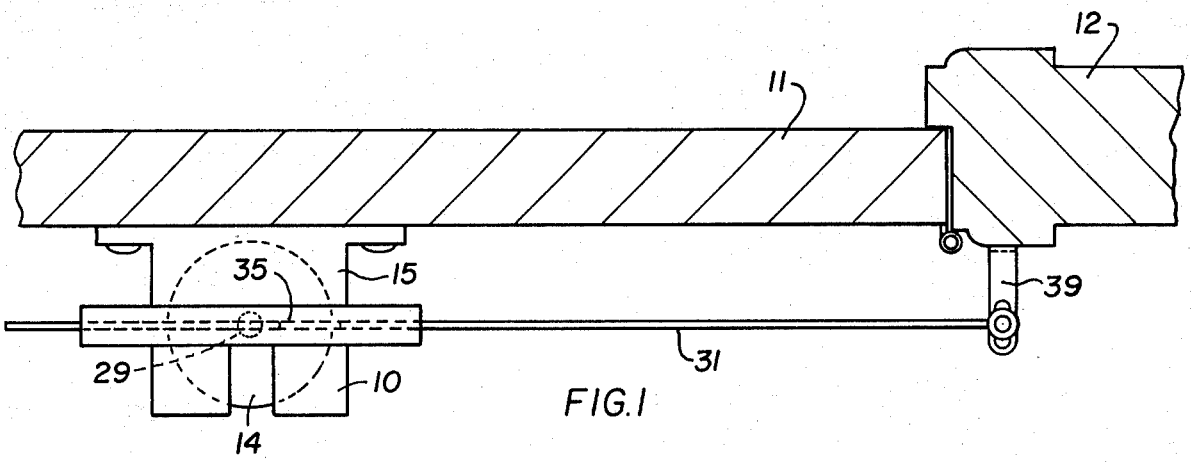
FIG. 1 is a plan view of the invention mounted to a closed door.
Figure 2:
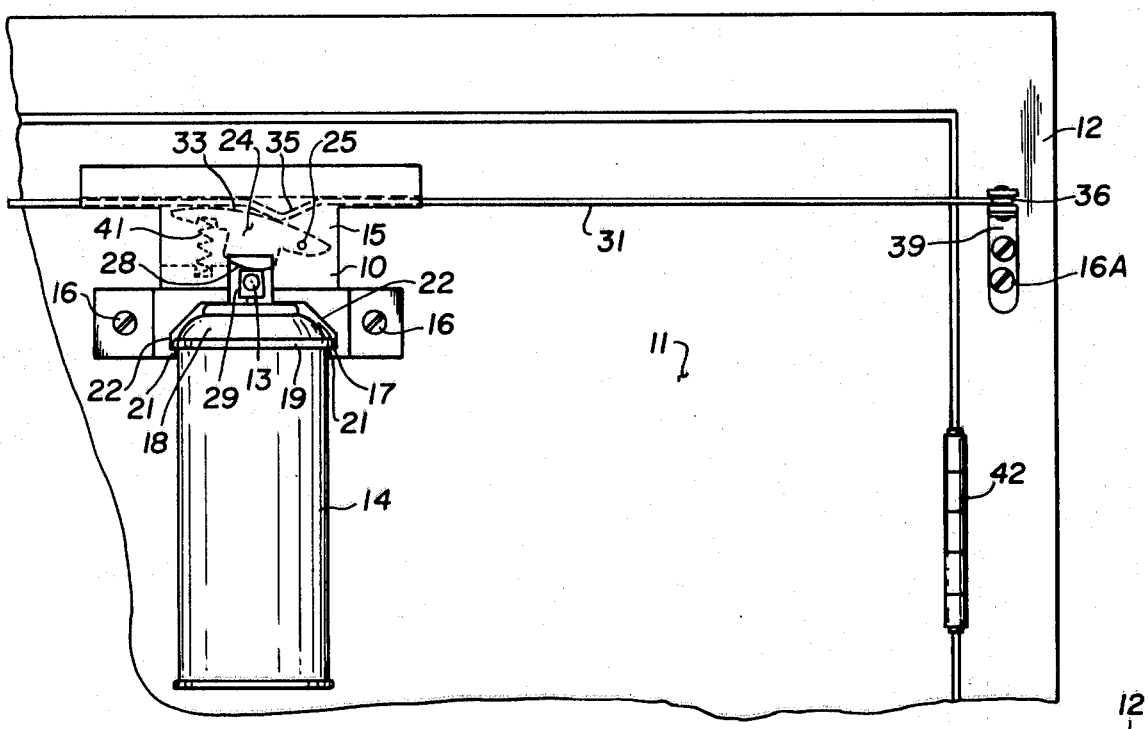
FIG. 2 is an elevation view of the invention, in use.
Figure 3:
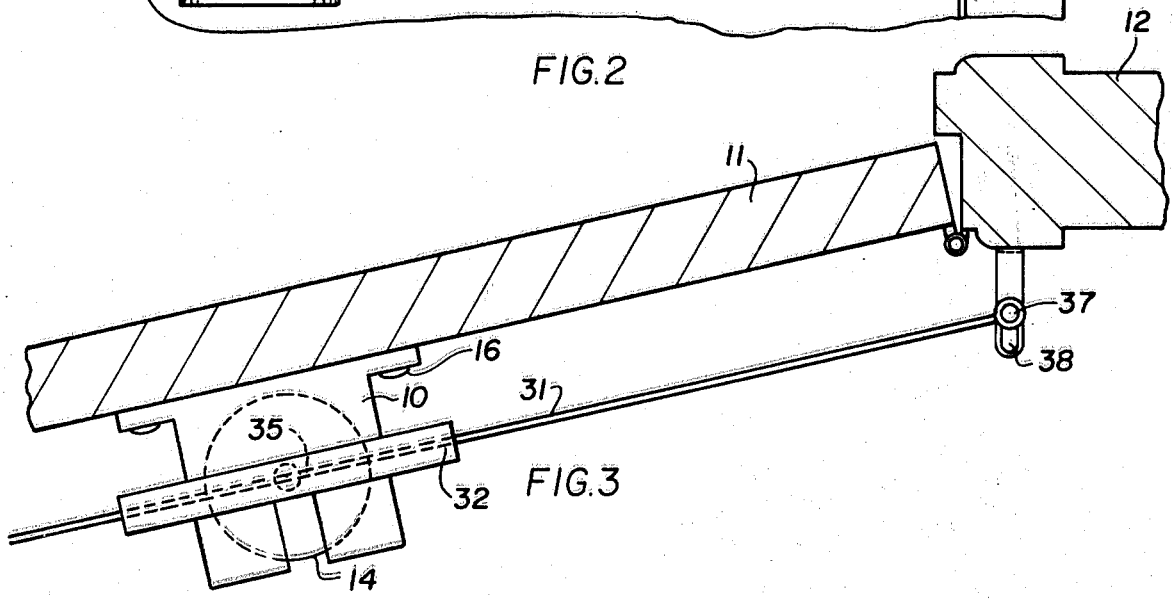
FIG. 3 is a plan view of the mounted invention, with the attached door in the opened position.

Turning now descriptively to the drawings, in which similar reference characters denote similar elements throughout the several views, FIGS. 1–3 show the invention 10 fastened to door 11, and to door jamb 12 so as to eject a spray from the nozzle outlet 13 of aerosol can 14 held in the bracket 15 of the invention when door 11 is opened.

Bracket 15 is fastened by screws 16 to the face of door 11 and is fitted with a recess 17 in its underside of a size to freely admit the top section 18 of an aerosol spray can 14. A projection 21 on each side of the recess wall 22 fits under and supports the circular projecting rim 19 of can 14 to hold it in place in the bracket.

Knob 24 is pivotably mounted by pin 25 in the upper section of recess 17 and located so that the bottom edge 28 of knob 24 rests above the push button 29 of the attached aerosol can 14 with compression spring 41 mounted between knob 24 and the bracket 15 to keep knob 24 from resting on the push button 29 in the normal position of knob 24.

A rod 31 freely passes through a slot 32 in the bracket above the upper surface 33 of knob 24, with rod 31 fitted with a bent section 35 that depresses knob 24 when said bent section 35 passes directly above knob 24. An end of rod 31 is formed as an eye 36 that is fastened by a hinge pin 37 to a slot 38 in a bracket 39 mounted by screws 16A to the door jamb 12. Bracket 39 is mounted adjacent to but not directly on the line of the hinges 42 of door 11 so that the position of bent section 35 of rod 31 will move outwards with respect to knob 24 of bracket 15 when the door 11 is rotated from a closed position, shown in FIG. 1, to an open position shown in FIG. 3. As shown in FIG. 3, bent section 35 of rod 31 engages knob 24 to rotate knob 24 to depress aerosol can button 29 with the door 11 in the open position, causing a spray to eject from the nozzle 13 of can 14. In the closed position of door 11, bent section 35 of rod 31 is free of engagement with knob 24 and spring 41 biases knob 24 away from engagement with button 29 of aerosol can 14.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A device which is attachable to a door for ejecting a spray from a pressurized spray container, when the attached door is in an open position, in the form of a bracket shaped to detachably grip a pressurized spray container equipped with a push button spray nozzle valve, said bracket fitted with first means for selectively pressing against the nozzle valve of the pressurized spray container, with said first means are spring-biased to normally prevent the nozzle valve from being pressed, said first means responsive to a second means attachable to the door jamb of the attached door, such that the said second means actuates the said first means to engage the nozzle valve and open said valve when the door to which the device is attached is in the open position, in which the said second means is a shaped wire rod hinged to a bracket adaptable to be mounted on the jamb of the attached door.

2. The combination as recited in claim 1 in which the said second means is shaped to engage the nozzle valve in one particular open position of the attached door so that the device will momentarily eject a spray as the attached door is swung past the said particular open position.

* * * * *